US010737923B2

(12) United States Patent
Running

(10) Patent No.: US 10,737,923 B2
(45) Date of Patent: Aug. 11, 2020

(54) CAST CONTACT PADS

(71) Applicant: Cascade Corporation, Portland, OR (US)

(72) Inventor: Brent G. Running, Hood River, OR (US)

(73) Assignee: Cascade Corporation, Fairview, OR (US)

( * ) Notice: Subject to any disclaimer, the term of this patent is extended or adjusted under 35 U.S.C. 154(b) by 0 days.

(21) Appl. No.: 15/072,173

(22) Filed: Mar. 16, 2016

(65) Prior Publication Data

US 2017/0267505 A1 Sep. 21, 2017

(51) Int. Cl.
*B66F 9/18* (2006.01)
*B22D 19/00* (2006.01)

(52) U.S. Cl.
CPC ..... *B66F 9/184* (2013.01); *B22D 19/00* (2013.01)

(58) Field of Classification Search
CPC . B66F 9/18; B66F 9/184; B66C 23/00; B66C 19/00
See application file for complete search history.

(56) References Cited

U.S. PATENT DOCUMENTS 3,666,456 A 5/1972 Haller
4,099,988 A 7/1978 Horiuchi et al.
4,209,280 A 6/1980 Bittner
4,844,172 A * 7/1989 Lee ..... A01L 7/06 168/13
4,993,526 A * 2/1991 Morrison ..... A45C 13/36 190/125
5,174,457 A * 12/1992 Carroll ..... B61G 7/10 213/61
5,328,776 A 7/1994 Garber et al.
5,735,377 A * 4/1998 Herren ..... B65G 11/166 193/33

(Continued)

FOREIGN PATENT DOCUMENTS

CN 102439233 B 3/2015
IT 1097117 B 8/1985

OTHER PUBLICATIONS

International Search Report prepared by the US Patent and Trademark Office for PCTUS2016/069384, dated Mar. 10, 2017, 3 pages.

(Continued)

*Primary Examiner* — Saul Rodriguez
*Assistant Examiner* — Ashley K Romano
(74) *Attorney, Agent, or Firm* — Chernoff, Vilhauer, McClung & Stenzel, LLP

(57) ABSTRACT

A contact pad is provided having a load-engaging front surface and an oppositely-facing rear surface, preferably comprising a cast metal contact pad having at least one depression adjacent to the rear surface and a tile embedded within the depression such that the tile has an exposed surface, and a wear element on the exposed surface. A method for manufacturing a contact pad having a load-engaging front surface and an oppositely-facing rear surface preferably includes the steps of embedding a mild steel tile within a contact pad casting pattern such that, once embedded, the embedded tile has an exposed weldable surface, casting the contact pad from ductile cast iron and applying a wear element on the weldable surface.

16 Claims, 3 Drawing Sheets

(56) References Cited

U.S. PATENT DOCUMENTS

| | | | | |
|---|---|---|---|---|
| 6,386,586 | B1 * | 5/2002 | Ulery, Jr. | B60S 9/02 212/301 |
| 7,073,821 | B2 * | 7/2006 | Lagsdin | B60S 9/02 248/633 |
| 8,011,739 | B2 * | 9/2011 | Busley | B62D 55/275 305/189 |
| 8,864,202 | B1 | 10/2014 | Schrameyer | |
| 8,998,164 | B2 * | 4/2015 | Marquardt | F16M 11/36 248/188.9 |
| 9,273,669 | B2 * | 3/2016 | Nielsen | F16J 1/003 |
| 9,469,975 | B2 * | 10/2016 | Sheehan | E02F 9/2883 |
| 2004/0208737 | A1 | 10/2004 | Schmidtlein | |
| 2005/0037215 | A1 | 2/2005 | Ishiduka et al. | |
| 2010/0143742 | A1 | 6/2010 | Tsypine et al. | |
| 2016/0031005 | A1 | 2/2016 | Melekian | |

OTHER PUBLICATIONS

Written Opinion prepared by the US Patent and Trademark Office for PCTUS2016/069384, dated Mar. 10, 2017, 8 pages.

* cited by examiner

CAST CONTACT PADS

BACKGROUND OF THE INVENTION

Lift trucks use an attached clamping device to handle rolls of various paper types. The ability of such clamping devices to lift and move a roll of paper without damage is highly dependent upon the contact pads used. Contact pads are used with a paper roll clamp and make actual contact with the outside cylindrical surface of the paper roll. A textured, curved contact surface is usually designed into the load-engaging front surface of the contact pad in order to balance the needs of load holding and damage prevention.

Handling paper rolls often results in abrasion or wearing of the rear surface of the contact pad. Normal wearing of the contact pad is due to sliding the rear surface of the contact pad along a paved ground surface. Contact pad service life can be dramatically reduced by such wear, thereby requiring frequent replacement.

SUMMARY OF THE INVENTION

In one embodiment, this invention relates to a contact pad having a load-engaging front surface, and an oppositely-facing cast metal rear surface having at least one depression and a tile embedded within the depression such that the tile has an exposed surface with a wear element welded on the exposed surface.

In another embodiment, the wear element is hard surfacing. In another embodiment, the foregoing tile is a mild steel tile embedded within the depression.

This invention also relates to a method for manufacturing a contact pad having a load-engaging front surface and an oppositely-facing rear surface including the steps of embedding a mild steel tile within a contact pad casting pattern such that the embedded tile has an exposed weldable surface, casting the contact pad from ductile cast iron, and applying a wear element on the weldable surface.

In another embodiment, the applying step includes applying hard-surfacing on the weldable surface.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 2:
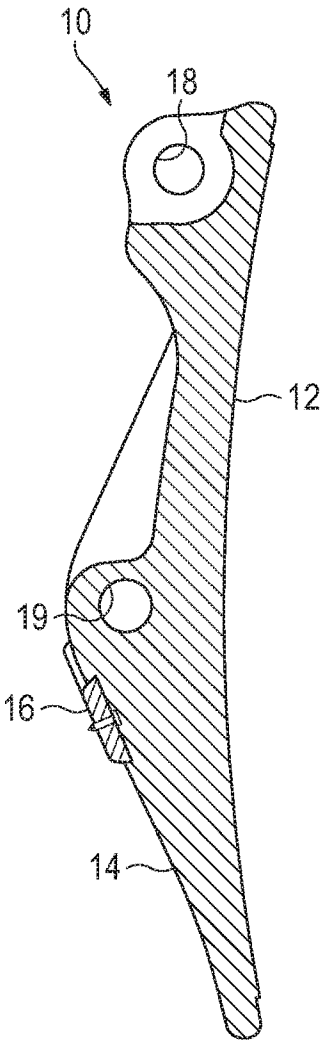
FIG. 2 is a sectional view of the contact pad of FIG. 1 taken along the line 2-2.
Figure 1:
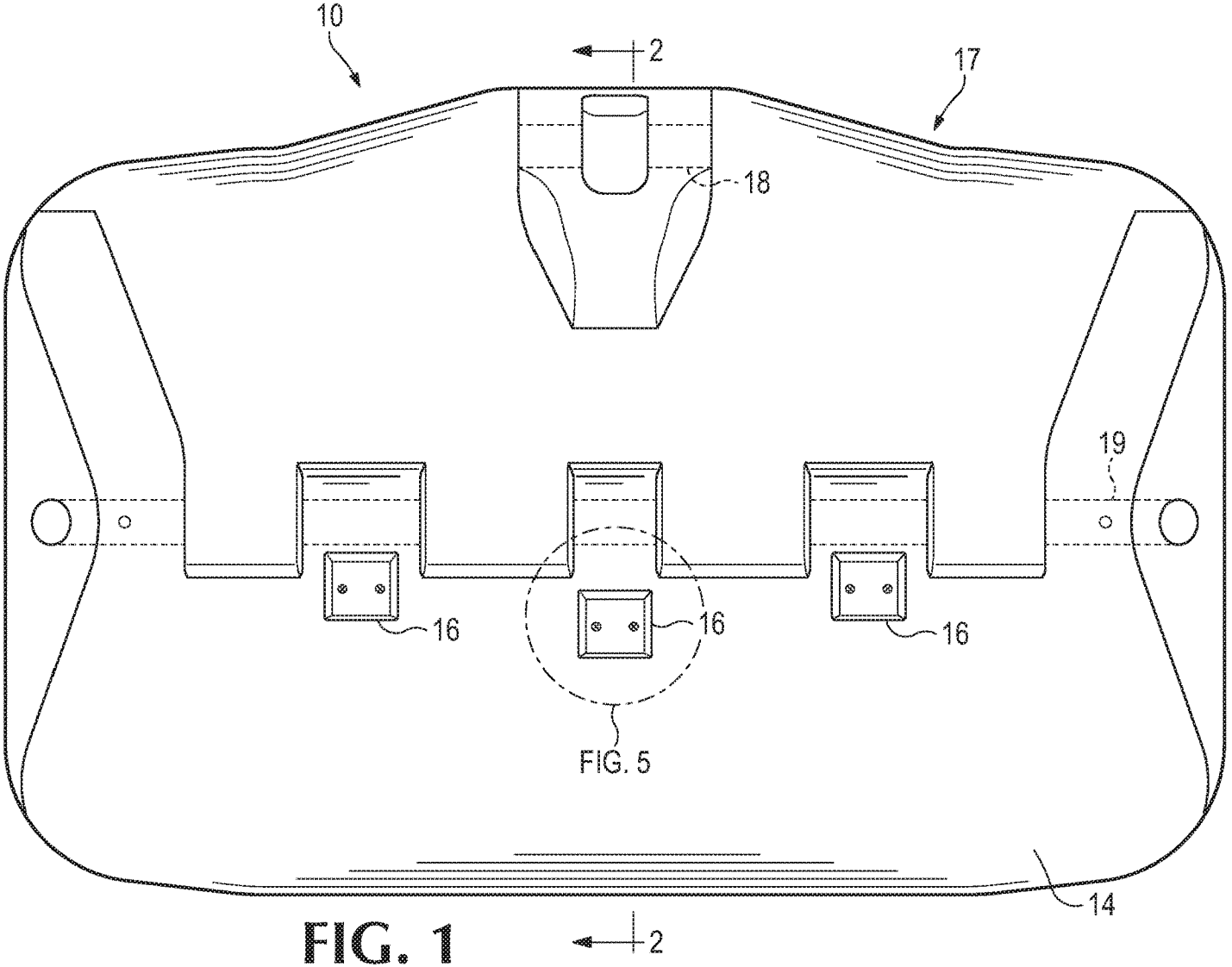
FIG. 1 is a plan view of a contact pad with three unfinished embedded tiles.

Referring now to the drawings which form a part of the disclosure herein, each contact pad 10 has a front, or load-engaging, surface 12 as best shown in FIG. 2, and a rear surface 14. The contact pad 10 shown has one or more tiles, such as 16, each of which are embedded in the rear surface 14 of the pad. The rear surface 14 of the contact pad, when in use, normally comes into forced moving contact with a paved ground surface as it is inserted beneath a horizontally-oriented paper roll in preparation to clamping it. The contact pad 10 is pivotally connectable to a lift truck clamp arm 17 at pivot joints 18 and 19. However, in other embodiments of the invention, the contact pad may be attached to a lift truck in other conventional manners.

FIGS. 5-8 show an embodiment of a cast tile 16. In one embodiment of the invention, the tile 16 is preferably made of steel, or mild steel, or any material capable of withstanding molten metal surrounding it without deforming. In one exemplified embodiment of the invention, the tile 16 has four sides 20 of equal length, and a height 22. In this embodiment of the present invention, the height 22 of the tile is less than the length of the sides 20. In other embodiments of the invention, depending on manufacturing requirements, the tile 16 may be manufactured with different-length sides and heights. The tile 16 may also be manufactured in a different shape. The tile 16 may preferably have sides that slant and/or curve so that the sides go from the broader base of the tile 28 to the smaller top of the tile 30. This gradation between the base of the tile 28 to the top of the tile 30 may be varied based on the manufacturer's needs. In the shown embodiment of the tile 16, the base 28 is broader than the top 30 of the tile so that the surrounding cast contact pad 10 better encompasses and retains the embedded tile 16.

Figure 5:
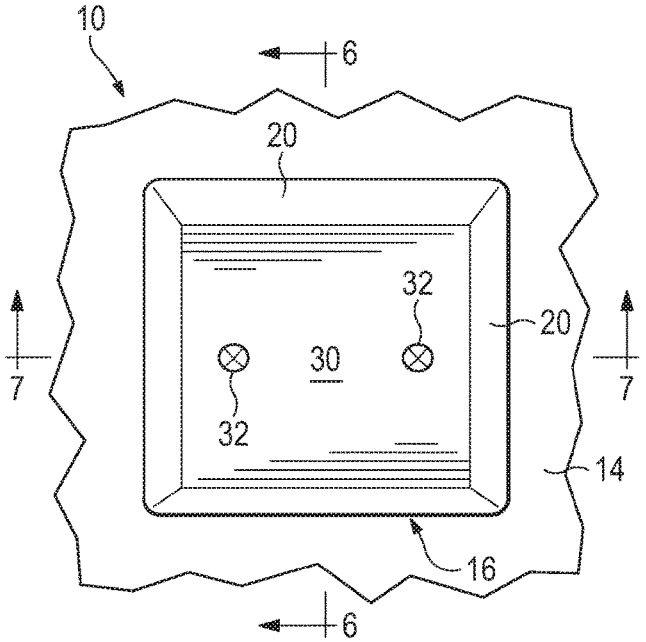
FIG. 5 is an enlarged plan view of a single unfinished tile as indicated by the dotted line in FIG. 1.
Figure 6:
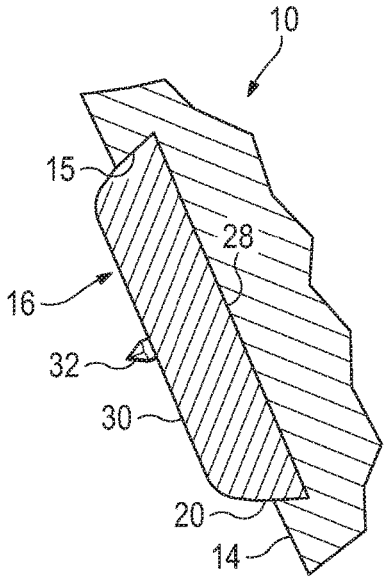
FIG. 6 is an enlarged sectional view of the unfinished tile taken along line 6-6 of FIG. 5.
Figure 7:
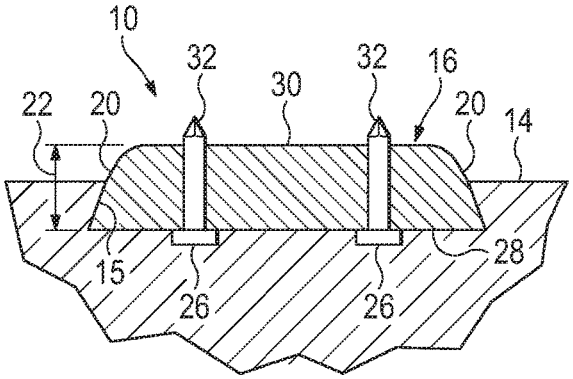
FIG. 7 is an enlarged sectional view of the unfinished tile taken along line 7-7 of FIG. 5.
Figure 8:
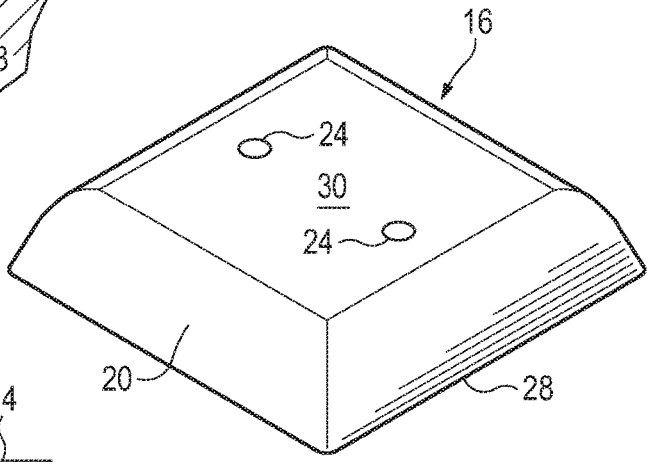
FIG. 8 is an isometric view of the unfinished tile of FIG. 5.

The tile 16 in this embodiment is preferably constructed with dual bores or holes 24, each capable of accepting a nail 26 or other stabilizing element. FIGS. 5-7 show the holes 24 with nails 26 inserted within the holes 24. As will be described in more detail, the nail 26 can be inserted into the tile 16 from the bottom of the tile, to secure the tile in position in a sand casting pattern. In other embodiments of the present invention, different types of mechanical connectors may be used instead of a nail to secure the tile in position in a sand casting pattern or, as shown in FIG. 8, the tile 16 can be cast without nails or other stabilizing elements depending on the application.

FIGS. 1, 2, and 5-8 show tiles 16 embedded and secured in the contact pad 10, with the tiles protruding above the rear surface 14 of the pad 10. As shown in FIGS. 2, 6 and 7, the top of the embedded tile 30, and the tip of the nail 32, extend beyond the rear surface 14 of the contact pad 10. In some embodiments, however, the tip of the nail 32 does not extend beyond the top of the embedded tile (not shown).

Figure 4:
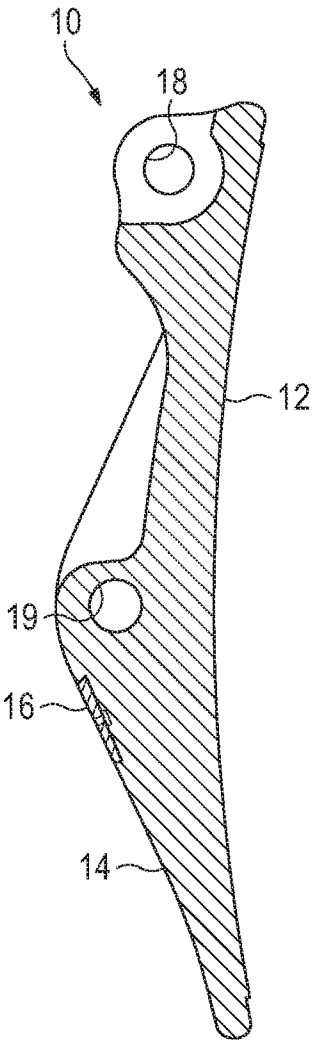
FIG. 4 is a sectional view of the contact pad taken along line 4-4 shown in FIG.
Figure 3:
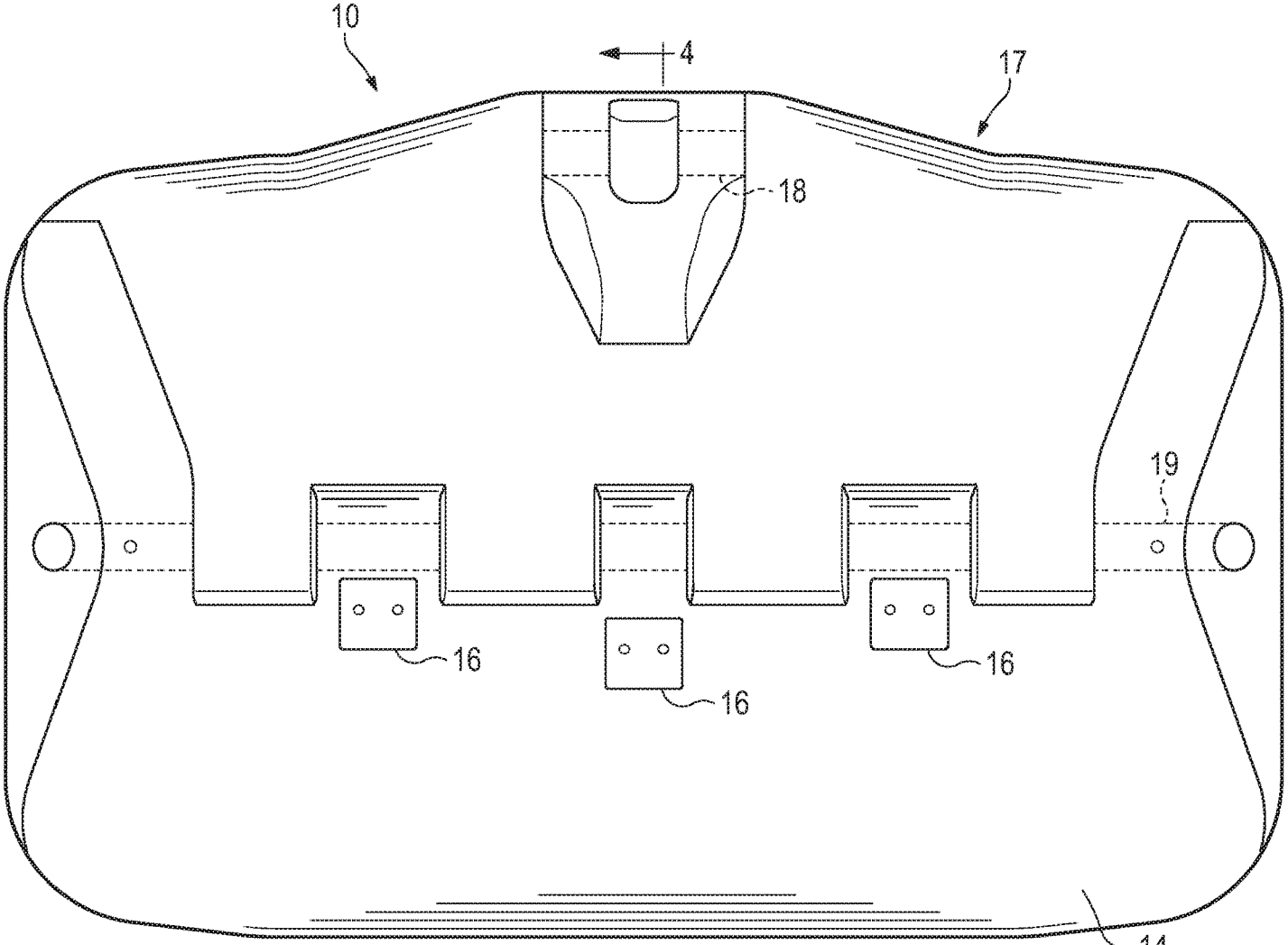
FIG. 3 is a plan view of the contact pad with three finished embedded tiles.

Alternatively, FIGS. 3 and 4 show the contact pad 10, with tiles 16 embedded and with the exposed surface of each tile 16 and the ends of the nails 32 finished and/or ground down so that the tile 16 is flush with the rear surface 14 of the contact pad 10, as best viewable in FIG. 4.

Figure 9:
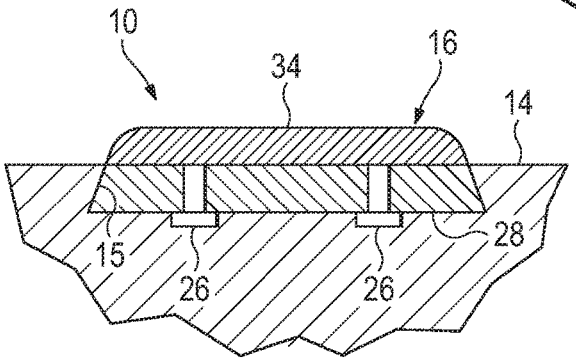
FIG. 9 is an enlarged sectional view of a finished embedded tile with hard-surfacing applied.

As a further alternative, FIG. 9 shows a portion of the contact pad 10 with the ground down tile and nails 16, 26, with a layer of wear element 34, such that the wear element is a wear-resistant element. Alternatively, the wear element may be hard-surfacing. The range of thickness for the hard-surfacing wear element 34 as shown in FIG. 9 is preferably 2 mm to 8 mm. The wear element 34 may take other forms, such as plates or bars, depending on manufacturing needs (not shown).

The manufacturing process herein provides manufacturing cost advantages for the fabrication of the contact pads. A purpose of the tile 16 is to facilitate application of a wear element or hard-surfacing 34 on a cast contact pad using common weld practices. Without the tile 16, applying a wear element 34 directly on to the ductile iron contact pad 10 would involve uncommon and specialized welding procedures. Therefore, the tile 16 provides a surface that allows for the application of the wear element 34 thereby allowing a contact pad 10 to be refurbished with the application of additional wear element, such as hard-surfacing, when previously-applied hard-surfacing is worn down from use.

To manufacture such a contact pad, a sand casting (not shown) with a negative imprint or cavity of the contact pad 10 is used. The sand casting is constructed with means to pour molten metal into the cavity and means to allow air to escape to create the sand casting pattern. The sand casting pattern may be created in two halves such that the plane where the two halves meet creates the parting line and runs along a central plane of the final cast pattern. The sand casting may include depressions such as 15 to indicate the positions in which one or more of the tiles 16 should be placed. The purpose of such depressions is to aid a manufacturer in locating the positions where individual tiles should be placed.

Prior to pouring molten metal into the sand casting, one or more pre-made tiles 16 are placed within the depressions in one of the two halves of the sand pattern. The tiles may be secured by pushing a nail 26 or other connector through the one or more holes 24, into the sand casting. Such securement is to avoid movement of the tile as molten metal flows over and around the tile. The securement thereby provides a reliable and low cost means of providing stability. However, the depressions 15 also aid the manufacturer in keeping a tile in place as molten metal is poured into the casting pattern, as will be described. Therefore, in some embodiments of the invention the tiles are placed within depressions without the use of nails 26 or other connectors.

After placing the tiles in position, to form the final casting pattern, the two blocks of the sand casting are assembled together to create a fully enclosed cavity, the cavity thereby having the dimensions of the desired contact pad. Gates and risers (not shown) are added to provide the means for pouring in the molten metal and allowing air to escape. Molten metal is poured into the final casting pattern and the ductile iron surrounds and captures the tile(s) within the cast contact pad and the tile(s) become part of the final casting.

The final cast contact pad can then be separated from the sand casting mechanically by impact or shaking.

After the final contact pad has been cast, each tile, and in some embodiments the tip of the nail(s), can be ground down or finished so that the top of the tile is flush with the surrounding cast surface, as shown in FIGS. 3 and 4. Regardless of whether or not such finishing has occurred, the wear element or hard-surfacing 34 is then welded or deposited onto the exposed tile surface and applied to a selected thickness, as exemplified in FIG. 9. Additional desired features may also be applied to the contact pad and then the pad is ready for assembly onto a paper roll clamp arm such as 17. In another embodiment of the invention, however, the wear element 34 could be applied onto the tile prior to securing it into the sand casting, prior to casting the contact pad.

Primary benefits to casting the tile directly into the contact pad are cost efficiency and retainment. Conversely, machining features to accommodate mechanically fastening a wear tile to a contact pad, and the related fasteners, are costly and do not reliably retain the wear tile.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An apparatus comprising:

a) a cast metal contact pad having a front surface and an oppositely-facing rear surface, at least one depression adjacent to said rear surface, b) a tile, having sides that make up a perimeter, embedded immovably within said depression, wherein the depression has continuous sides that surround the perimeter of the tile, said tile having an attachment surface; and c) a wear element welded to said attachment surface that wears down during use of the contact pad.

2. The apparatus of claim 1 wherein the wear element is hard-surfacing.

3. The apparatus of claim 1 wherein said tile is immovably secured within said depression by surrounding cast metal of said contact pad.

4. The apparatus of claim 1 wherein said tile is immovably secured within said depression by one or more mechanical connectors.

5. The apparatus of claim 4 wherein the attachment surface is configured to facilitate the welding of a second wear element to said attachment surface when the wear element has worn to expose the attachment surface.

6. The apparatus of claim 1 wherein the tile is constructed with a hole, capable of accepting a nail.

7. The apparatus of claim 1 wherein the tile has a rectangular shape.

8. The apparatus of claim 1 wherein the tile has a width, a length and a height, such that the height of the tile is less than the length and the width.

9. An apparatus comprising:

a) a front surface and an oppositely-facing rear surface, at least one depression adjacent to said rear surface;

b) a mild steel tile immovably engaged within said at least one depression, wherein said tile has a perimeter and said depression has sides that surround the perimeter, said tile having an attachment surface; and c) a wear element attached to said surface, wherein said tile maintains engagement within the said at least one depression when the wear element has worn down to the attachment surface.

10. The apparatus of claim 9 wherein said wear element is hard-surfacing.

11. The apparatus of claim 9 wherein said tile is immovably secured within said depression by surrounding cast ductile iron of said contact pad.

12. The apparatus of claim 9 wherein said tile is immovably secured within said depression by at least one mechanical connector.

13. The apparatus claim 12 wherein the mechanical connector is a nail.

14. The apparatus of claim 9 wherein the depression and the tile are constructed with holes, capable of accepting a nail.

15. The apparatus of claim 9 wherein the tile has a rectangular shape.

16. The apparatus of claim 9 wherein the tile has a width, a length and a depth, such that the depth of the tile is less than the length and the width.

* * * * *